US005706999A

United States Patent [19]

Lim et al.

[11] Patent Number: 5,706,999

[45] Date of Patent: Jan. 13, 1998

[54] PREPARATION OF A COATED METAL-MATRIX COMPOSITE MATERIAL

[75] Inventors: John K. Lim, Fullerton; Joseph S. Russo, Chatsworth, both of Calif.

[73] Assignee: Hughes Electronics, Los Angeles, Calif.

[21] Appl. No.: 563,710

[22] Filed: Nov. 28, 1995

[51] Int. Cl.[6] ..... B23K 31/02; B05D 3/02; B05D 5/12; C23C 28/02

[52] U.S. Cl. ..... 228/123.1; 427/305; 427/372.2; 427/376.6; 427/376.7; 427/123; 427/126.1; 427/98; 148/688; 205/187; 205/183; 205/184; 205/220; 205/224; 205/917

[58] Field of Search ..... 427/305, 372.2, 427/376.1, 376.6, 399, 376.7, 375, 126.1, 126.2, 98, 123; 148/675, 688; 205/187, 183, 184, 271, 266, 220, 224, 917; 228/123.1

[56] References Cited

U.S. PATENT DOCUMENTS 4,407,860 10/1983 Fleming et al. ..... 427/98
4,795,658 1/1989 Kano et al. ..... 427/98
4,983,428 1/1991 Hodgens, II ..... 427/443.1
5,058,799 10/1991 Zsamboky ..... 228/124
5,358,907 10/1994 Wong ..... 437/230
5,433,260 7/1995 Taylor ..... 164/97
5,455,118 10/1995 Cook ..... 428/555

*Primary Examiner*—Shrive Beck
*Assistant Examiner*—Michael Barr
*Attorney, Agent, or Firm*—G. R. Lindeen, III; W. K. Denson-Low

[57] ABSTRACT

A composite material of silicon carbide particles in an aluminum matrix is base coated with a layer of a nickel-boron alloy by an electroless process. The base-coated composite material is heat treated at a temperature of about 450° C. to interdiffuse the base coating with the composite material. A nickel or gold top layer is electrolytically deposited over the base coat on the heat-treated composite material.

17 Claims, 2 Drawing Sheets

PREPARATION OF A COATED METAL-MATRIX COMPOSITE MATERIAL

BACKGROUND OF THE INVENTION

This invention relates to metal-matrix composite materials, and, more particularly, to the preparation of such materials that are coated with metallic top coatings.

One type of composite material typically has a matrix phase with a large number of particles embedded therein. The matrix can be a metal, as it is for the purposes of the present invention, a ceramic, or a nonmetal. The particles can be substantially equiaxed or elongated, and can be of any composition that does not dissolve in the matrix alloy. In the composite material, the components retain their physical identifies, unlike an alloy where the separate identifies of the components are lost.

Composite materials are used in a wide variety of structural and other applications, because they can be tailored to achieve specific properties by the selection of the components, their relative fractions, and their positioning and orientation. In one application of particular interest to the inventors, a metal-matrix composite material is used as a heat sink for electronic components in aerospace applications. The matrix is preferably aluminum for high thermal conductivity, and the reinforcing particles are present to reduce the coefficient of thermal expansion of the composite material to more closely match that of the ceramic or semi-metal electronic devices that are affixed to the heat sink.

It is preferred that the electronic device to be cooled by the heat sink be soldered or brazed to the heat sink. However, it is difficult to form solder or braze joints directly between aluminum and ceramics or semi-metals. It is therefore known to coat the metal-matrix composite material with a metallic top coating such as nickel or gold in order to facilitate the soldering or brazing.

With existing techniques for depositing the top coating onto the body of the heat sink, it has been found that blisters form between the top coating and the metal-matrix composite material of the heat sink when the coated composite material is heated to temperatures of greater than about 250° C. These blisters lead to a delamination and failure of the heat-sinked electronic device structure. This blistering temperature therefore establishes a maximum temperature at which the soldering or brazing of the electronic device to the heat sink can be conducted, and also limits the service temperature of the heat sink and the electronic device affixed to the heat sink. Fabrication or service at temperatures above about 250° C. leads to blistering and failures.

There is a need for an approach that allows the heat sink and electronic device to be soldered or brazed at higher temperatures, so that joining materials with higher-temperature capabilities can be used. Such an approach would also permit the heat sink and affixed electronic device to be used at higher service temperatures. The present invention fulfills this need, and further provides related advantages.

SUMMARY OF THE INVENTION

The present invention provides a method of preparing a coated metal-matrix composite material which is resistant to the formation of blisters and related defects to higher temperatures than previously possible, and coated metal-matrix composite materials made by this approach. The method of the invention allows the use of the same composite and coating materials as presently known, avoiding the need for the development of new soldering or brazing techniques. The approach of the invention is readily implemented with minimal additional cost to the manufacturing operation.

In accordance with the invention, a method for preparing a coated metal-matrix composite material comprises the steps of furnishing a piece of a composite material having an aluminum matrix and reinforcement particles dispersed therein, depositing a metallic base coating having a first composition onto at least a portion of the piece of composite material to form a base-coated composite material, heating the base-coated composite material to a temperature and for a time sufficient to cause the base coating to interdiffuse into the piece of composite material, forming a heat-treated composite material, and depositing a metallic top coating having a second composition overlying the base coating on the heat-treated composite material.

More specifically in a preferred embodiment, a method for preparing a coated metal-matrix composite material comprises the steps of furnishing a piece of a composite material having an aluminum matrix and silicon carbide reinforcement particles dispersed therein, depositing by an electroless process a nickel-boron metallic base coating onto at least a portion of the piece of composite material to form a base-coated composite material, heating the base-coated composite material to a temperature of from about 440° C. to about 460° C. for a time of from about 14 hours to about 16 hours in nitrogen gas, and depositing by an electrolytic process a metallic top coating having a second composition overlying the base coating on the heat-treated composite material. The top coating is either a nickel alloy and a gold alloy.

The resulting coated composite material is suitable for the bonding thereto of a second structure, such as an electronic device for which the composite material acts as a heat sink. The top coating does not blister at temperatures higher than those achieved with conventional top coating procedures, and typically does not blister at temperatures of up to about 400° C. Conventional joining techniques such as soldering or brazing can be used, but the stability of the top coating permits higher-temperature joining materials to be used. The heat sink and affixed structure are stably bonded to temperatures of up to about 400° C., and be used at such service temperatures.

Other features and advantages of the present invention will be apparent from the following more detailed description of the preferred embodiment, taken in conjunction with the accompanying drawings, which illustrate, by way of example, the principles of the invention.

DETAILED DESCRIPTION OF THE INVENTION

Figure 1:
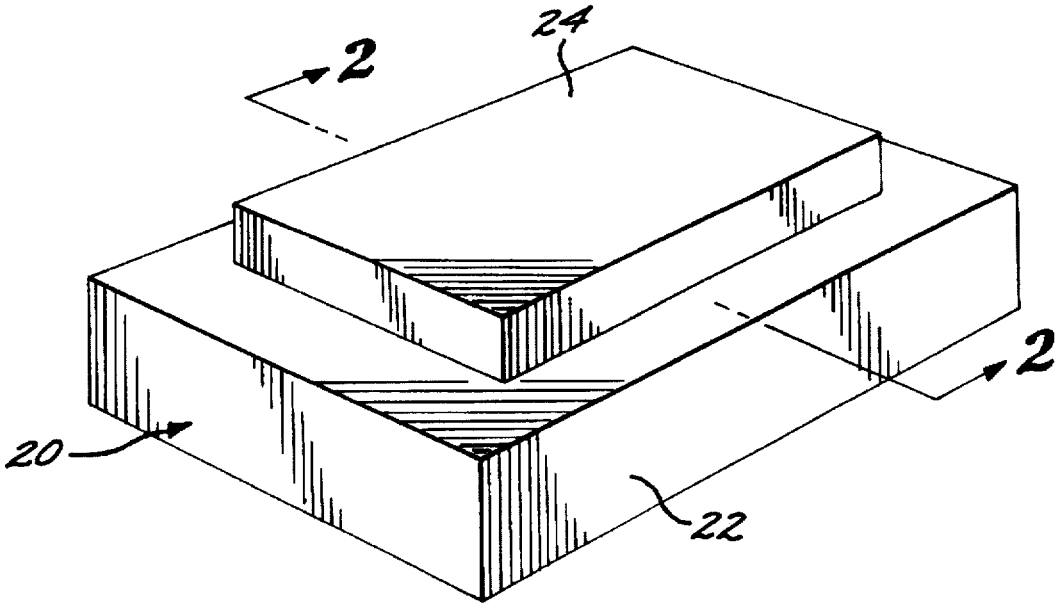
FIG. 1 is a perspective view of a composite material heat sink and affixed electronic device.

FIG. 1 depicts a piece of coated metal-matrix composite material 20 that is used as a heat sink 22. An electronic device 24 is fixed to the heat sink 22 in a manner that allows a high thermal flux from the electronic device 24 to the heat sink 22. The electronic device 24 can be any type of device. The inventors' preferred utilization of the composite material of the invention is as a heat sink, but its use is not so limited.

Figure 2:
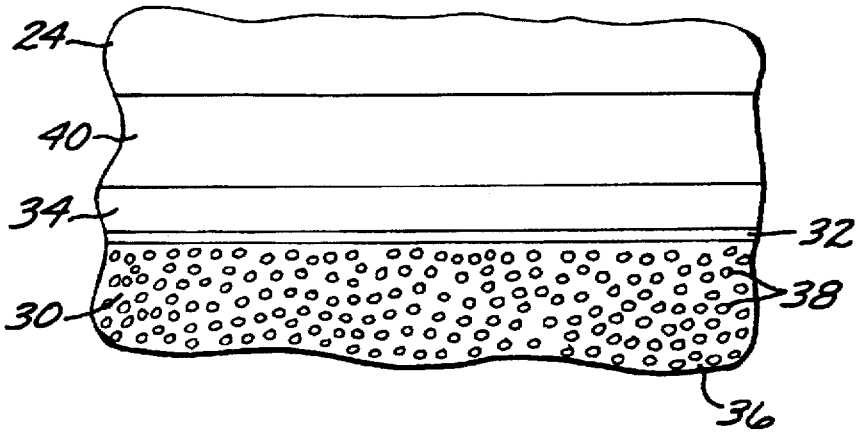
FIG. 2 is an enlarged schematic sectional view through the composite material and electronic device of FIG. 1, taken generally along lines 2—2.

FIG. 2 is a schematic cross sectional view through the structure of FIG. 1. FIG. 2 illustrates the elements of structure but is not drawn to scale. The coated metal-matrix composite material 20 includes a piece of metal-matrix composite material 30, which serves as a substrate. The composite material 30 preferably has an aluminum matrix 36. As used herein, a reference to a metal includes both the pure metal and its alloys. Thus, an "aluminum" matrix can be pure aluminum such as 1100 grade aluminum, or an aluminum-rich alloy wherein at least about 50 percent by weight of the material is aluminum. Reinforcing particles 38 are dispersed through the matrix 36. The particles 38 are a nonmetallic ceramic material, and are most preferably silicon carbide. The particles 38 are preferably of a size of from about 200 to about 1000 micrometers, and are present in an amount of from about 65 to about 70 percent by volume of the composite material 30. The presence of the particles 38 reduces the thermal expansion coefficient of the heat sink 22 to more closely match that of the electronic device 24, which typically presents a ceramic or semi-metal external face toward the heat sink 22.

Figure 3:
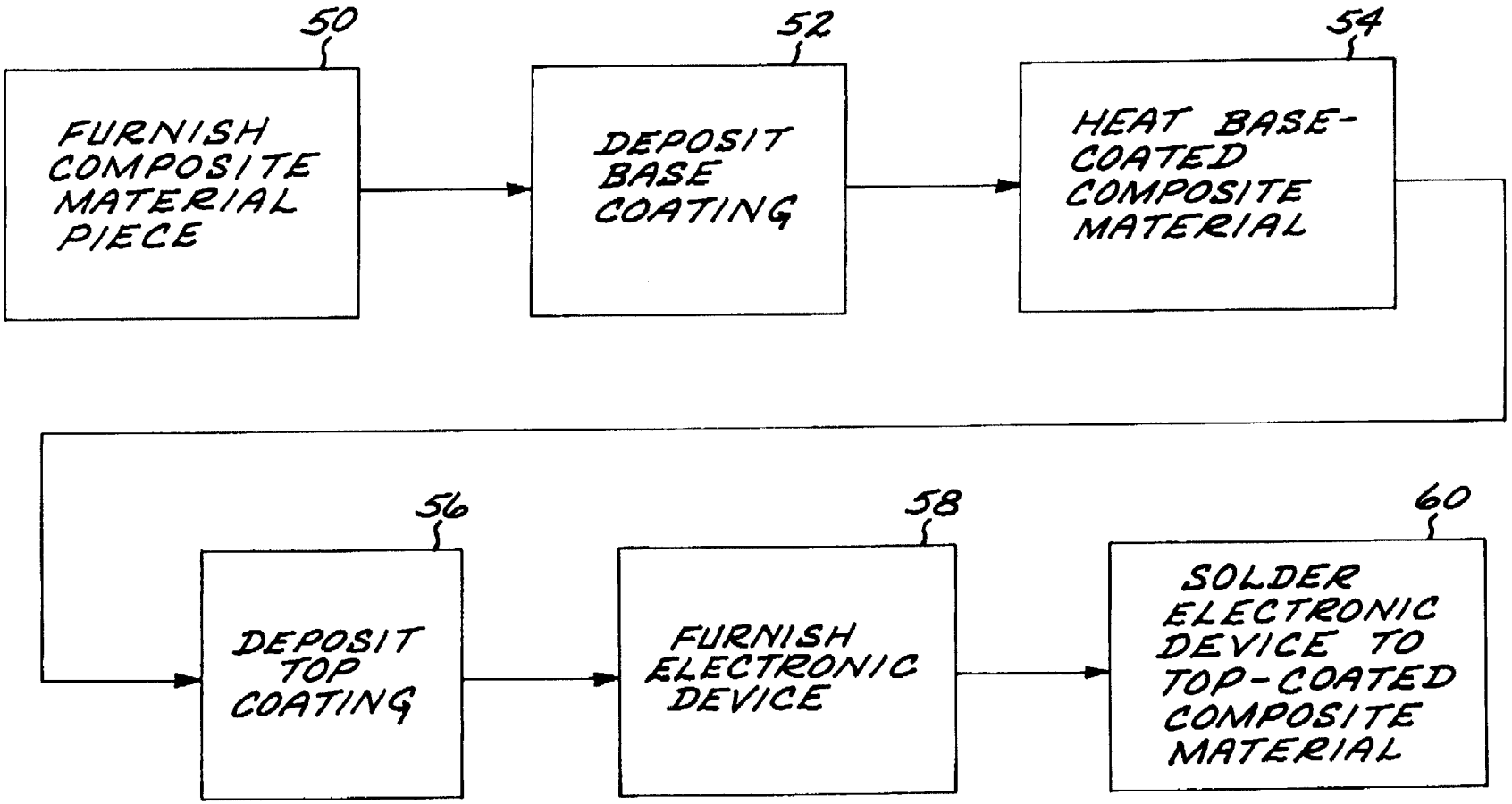
FIG. 3 is a block flow diagram for a method for preparing a coated composite material, and for preparing the composite material and affixed electronic device.

The composite material 30 substrate is coated to improve its ability to be bonded to the electronic device 24. FIG. 3 depicts the procedure for coating the composite material, and FIG. 2 shows the layers that are deposited in the coating operation. The piece of composite material 30 that is to be coated is furnished, numeral 50.

A metallic base coating 32 is deposited over the composite material 30, numeral 52. The base coating is preferably a nickel-boron alloy deposited by an electroless (i.e., non electrolytic) process. In the preferred coating process, the composite material 30 is cleaned in an alkaline cleaner, rinsed in cold water, pickled in an aqueous 10 percent hydrochloric acid solution for one minute, and rinsed in cold water. It is then activated in a palladium solution, rinsed in cold water, and electroless plated. The plating solution is preferably 20 grams per liter of nickel chloride, 0.7 grams per liter of sodium borohydride, 45 grams per liter of ethylene diamine tetraacetic acid (EDTA), with stabilizers added as necessary. The electroless plating is conducted at a pH of 6–8, a temperature of about 60°–70° C., and with the solution agitated. The base coating 32 can be any operable thickness, but is preferred to be 150–250 microinches in thickness.

The base-coated composite material is heated to a temperature and for a time sufficient to cause the material of the base coating 32 to partially interdiffuse into the piece of composite material 30, numeral 54. The heat treatment is preferably accomplished at a temperature of from about 425° C. to about 475° C., and for a time of from about 10 to about 20 hours. Most preferably, the heat treatment is at a temperature of 450° C.±10° C. for 15 hours±1 hour. The heat treatment is performed in 99.999 percent purity, moisture-free nitrogen gas to avoid oxidation of the base coat.

A metallic top coating 34 is deposited over the base coating 32 of the heat-treated composite material, numeral 56. The selection of the top coating 34 is dependent upon the planned use of the final coated metal matrix composite material, and any operable top coating 34 can be used. For the application of a heat sink illustrated in FIG. 1, the top coating is used to aid in wetting and adherence of a solder or braze metal to the heat sink. The top coating is therefore nickel (including pure nickel and nickel alloys) or gold (including pure gold and gold alloys), in a thickness of from about 60 to about 100 microinches, and is preferably applied in an electrolytic process. For a most preferred electrolytic nickel top coating 34, the nickel is applied by rinsing the bond-coated composite article in cold water, dipping in 10 percent sulfuric acid, rinsing in cold water, and plating electrolytically. The plating solution is 9–11 ounces per gallon nickel, 4–6 ounces per gallon boric acid, and 0.6 percent by volume of a wetting agent such as sodium lauryl sulfate. Deposition is accomplished at a pH of 3.5–4.5, a temperature of 135°–145° F., and a current density of 5–15 amperes per square foot.

The preparation of the top-coated metal-matrix composite material 20 is complete.

FIG. 3 also depicts the procedure for utilizing the top-coated metal-matrix composite material in the preparation of a heat-sinked electronic device. The electronic device 24 is furnished, numeral 58. The electronic device 24 is fixed to the top-coated metal-matrix composite material 20 by a technique that permits a high thermal flux between the electronic device 24, when it is in service, and the top-coated metal-matrix composite material 20. The electronic device is preferably fixed to the top-coated metal-matrix composite material by soldering or brazing, numeral 60. The preferred solder or braze material used to form a joining layer 40 is a eutectic composition of gold-tin or a eutectic composition of gold-germanium. Soldering or brazing is performed by heating the article to the required temperature of about 300°–400° C. in a belt or muffle furnace, or other furnace, where a non-oxidizing or inert atmosphere can be maintained, preferably an atmosphere of high-purity, low-moisture nitrogen gas.

The following examples are intended to illustrate aspects of the invention, but should not be taken as limiting the invention in any manner.

EXAMPLE 1

A top-coated metal-matrix composite material 20 was prepared in the manner discussed in relation to FIG. 2 and steps 50, 52, 54, and 56 of FIG. 3, with a top coating of gold. After the top-coated composite material was prepared, it was heated to 400° C. on a hot plate. No blisters were observed.

EXAMPLE 2

A coated metal matrix composite material was prepared by the same method as in Example 1, except that the heat treatment after the deposition of the base coating was replaced by baking of the material at 325° C. for 2 hours in air. After the top coating was applied, the top-coated composite material was heated to 400° C. on a hot plate. Extensive blistering was observed, making the material unsuitable as the heat sink for an electronic device.

EXAMPLE 3

The procedure of Example 2 was repeated using lower temperatures for the blistering test of the top-coated composite material. It was determined that exposure to temperatures of more than about 250° C. resulted in blistering. Consequently, the maximum soldering temperature and service temperature of this top-coated metal-matrix composite material is about 250° C., significantly limiting its use as compared with the material of the invention.

EXAMPLE 4

A top-coated metal-matrix composite material 20 was prepared in the manner discussed in relation to FIG. 2 and steps 50, 52, 54, and 56 of FIG. 3, with a top coating of gold. A small window-like frame was attached to the top-coated surface using a lead glass preform at a temperature of 450° C. There was no blistering and the joint was formed in a satisfactory manner.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A method for preparing a coated metal-matrix composite material, comprising the steps of:

furnishing a piece of a composite material having an aluminum matrix and reinforcement particles dispersed therein;

depositing a metallic base coating having a first composition onto at least a portion of the piece of composite material to form a base-coated composite material; thereafter heating the base-coated composite material to a temperature and for a time sufficient to cause the base coating to interdiffuse into the piece of composite material, forming a heat-treated composite material; and depositing a metallic top coating having a second composition directly onto the base coating on the heat-treated composite material.

2. The method of claim 1, wherein the step of furnishing includes the step of furnishing a piece of a composite material having an aluminum matrix and silicon carbide particles dispersed therein.

3. The method of claim 1, wherein the step of depositing a metallic base coating includes the step of depositing a metallic base coating by an electroless process.

4. The method of claim 1, wherein the step of depositing a metallic base coating includes the step of depositing a nickel-boron coating.

5. The method of claim 1, wherein the step of depositing a metallic base coating includes the step of depositing a metallic base coating of from about 150 to about 250 microinches thick.

6. The method of claim 1, wherein the step of heating includes the step of heating the base-coated composite material to a temperature of from about 425° C. to about 475° C.

7. The method of claim 1, wherein the step of heating includes the step of heating the base-coated composite material to a temperature of about 450° C. for a time of about 15 hours.

8. The method of claim 1, wherein the step of depositing a metallic top coating includes the step of depositing a top coating of a metal selected from the group of nickel and gold.

9. The method of claim 1, wherein the step of depositing a metallic top coating includes the step of depositing a top coating by an electrolytic process.

10. The method of claim 1, including an additional step, after the step of depositing a metallic top coating, of affixing an electronic device to the top coating.

11. The method of claim 10, wherein the step of affixing includes the step of affixing the electronic device to the top coating by a method selected from the group consisting of brazing and soldering.

12. A method for preparing a coated metal-matrix composite material, comprising the steps of:

furnishing a piece of a composite material having an aluminum matrix and silicon carbide reinforcement particles dispersed therein;

depositing by an electroless process a metallic base coating having a first composition onto at least a portion of the piece of composite material to form a base-coated composite material;

heating the base-coated composite material to a temperature of from about 440° C. to about 460° C. for a time of from about 14 hours to about 16 hours; and depositing by an electrolytic process a metallic top coating having a second composition directly onto the base coating on the heat-treated composite material.

13. The method of claim 12, wherein the step of depositing a metallic base coating includes the step of depositing a nickel-boron coating.

14. The method of claim 12, wherein the step of depositing a metallic base coating includes the step of depositing a metallic base coating of from about 150 microinches to about 250 microinches thick.

15. The method of claim 12, wherein the step of heating includes the step of heating the base-coated composite material in a high-purity, low-moisture nitrogen atmosphere.

16. The method of claim 12, wherein the step of depositing a metallic top coating includes the step of depositing a top coating of a metal selected from the group of nickel and gold.

17. A method for preparing a coated metal-matrix composite material, comprising the steps of:

furnishing a piece of a composite material having an aluminum matrix and silicon carbide reinforcement particles dispersed therein;

depositing by an electroless process a nickel-boron metallic base coating onto at least a portion of the piece of composite material to form a base-coated composite material;

heating the base-coated composite material in nitrogen gas to a temperature of from about 440° C. to about 460° C. for a time of from about 14 hours to about 16 hours; and depositing by an electrolytic process a metallic top coating having a second composition directly onto the base coating on the heat-treated composite material, the top coating having a composition selected from the group consisting of a nickel alloy and a gold alloy.

* * * * *

UNITED STATES PATENT AND TRADEMARK OFFICE

CERTIFICATE OF CORRECTION

PATENT NO : 5,706,999

DATED : January 13, 1998

INVENTOR(S) : John K. Lim

It is certified that error appears in the above-identified patent and that said Letters Patent is hereby corrected as shown below:

Column 1, line 3, insert the following:

--This invention was made with Government support under Contract No. N00030-93-C-0002 awarded by the Department of the Navy. The Government has certain rights in this invention.--

Signed and Sealed this

Twenty-first Day of December, 1999

*Attest:*

Q. TODD DICKINSON

*Attesting Officer*

*Acting Commissioner of Patents and Trademarks*